US005937868A

United States Patent [19]

Ogunro

[11] Patent Number: 5,937,868

[45] **Date of Patent: *Aug. 17, 1999**

[54] STRAND-SEPARATING APPARATUS

[76] Inventor: E. Olayinka Ogunro, 2727 Bolton Boone, Ste. 105, DeSoto, Tex. 75115

[ * ] Notice: This patent is subject to a terminal disclaimer.

[21] Appl. No.: 09/167,098

[22] Filed: Oct. 5, 1998

[51] Int. Cl.[6] ..... A45D 8/34; A45D 24/34

[52] U.S. Cl. ..... 132/213.1; 132/210; 132/139; 132/161

[58] Field of Search ..... 132/213.1, 213, 132/214, 210, 124, 126, 139, 140, 144, 148, 161, 270, 106, 200, 152

[56] References Cited

U.S. PATENT DOCUMENTS

| | | | |
|---|---|---|---|
| 302,734 | 7/1884 | Jobson | 132/139 |
| 592,049 | 10/1897 | Fischhaber | 132/245 |
| 619,805 | 2/1899 | Thompson | 132/249 |
| 850,553 | 4/1907 | West | 132/248 |
| 938,040 | 10/1909 | Caldwell | 132/148 |
| 3,696,823 | 10/1972 | Dannat | 132/122 |
| 4,038,996 | 8/1977 | Eronini et al. | 132/9 |
| 4,108,186 | 8/1978 | Esposto | 132/124 |
| 4,307,737 | 12/1981 | Shipman | 87/25 |
| 4,369,690 | 1/1983 | Sapkus | 87/33 |
| 4,580,585 | 4/1986 | Sapkus | 132/9 |
| 5,626,153 | 5/1997 | Petrarca | 132/144 |
| 5,704,376 | 1/1998 | Ogunro | 132/213.1 |

*Primary Examiner*—Todd E. Manahan
*Attorney, Agent, or Firm*—John A. Thomas

[57] ABSTRACT

An apparatus to separate hair into units of three for braiding, producing several such units in one application. The preferred embodiment comprises a platform having an upper shelf and an anchor. The anchor has comb-like teeth for fixing the device to the hair of the subject. The upper shelf prevents tangling of unbraided hair above the device. A blade, fixed perpendicularly to the platform, has a plurality of teeth separated by notches of alternating depths, which receive strands of hair. A lower shelf affixed at an angle acts as a support for the separated hair strands and prevents tangling. The upper and lower shelves are made removable. The width between braids may be varied by providing teeth of different widths on the upper shelf.

7 Claims, 3 Drawing Sheets

(VIEW 3-3)

(VIEW 4-4)

STRAND-SEPARATING APPARATUS

BACKGROUND

This invention relates to an apparatus for separating strands of hair, so as to facilitate braiding. Some modern hair styles rely on weaving small braids over the entire scalp and thus require considerable time and labor. The prior art discloses many inventions directed to mechanizing the task of braiding hair. Generally these are complex machines intended to completely mechanize the task of braiding. Such machines will be complicated to manufacture, and thus relatively expensive in the retail hair-care market. The present invention solves this problem by helping the braider initially measure and equally divide the strands of hair to braided. Generally, braiders work with at least three strands of hair. The present invention allows the human braider to separate the hair into units of three strands faster and more accurately than by hand, yet it is simple to manufacture and operate. It may be used to assist the braiding of natural hair, or the weaving of strands of artificial hair into natural hair. Further, the apparatus may be safely used by young children to braid hair, including doll hair. One embodiment of an apparatus having the desired characteristics is described in my United States patent, which issued Jan. 6, 1998 as U.S. Pat. No. 5,704,376.

SUMMARY

The foregoing and other objects of the invention are accomplished by separating the hair into units of three for braiding. The invention produces several such units in one application. The preferred embodiment comprises a platform having a shelf and an anchor. The anchor has comb-like teeth for fixing the device to the hair of the subject, usually starting near the crown of the head. The first shelf portion of the platform prevents tangling of unbraided hair above the device. A blade, fixed perpendicularly to the platform, has a plurality of teeth separated by notches of alternating depths. The operator presses strands of hair into these notches, and each group of three adjacent notches then holds a unit of three hair strands for braiding. A second shelf is fixed to the platform at an angle. This second shelf acts as a support for the separated hair strands and allows them to be more easily collected by the operator, and further prevents tangling with the remaining unbraided hair below the device. The width between braids may be varied by providing teeth of different spacings on the blade. The first and second shelf portions may be separately removed from the blade for more convenient use in tight hair styles or for easier handling.

DRAWINGS

DETAILED DESCRIPTION

Figure 1:
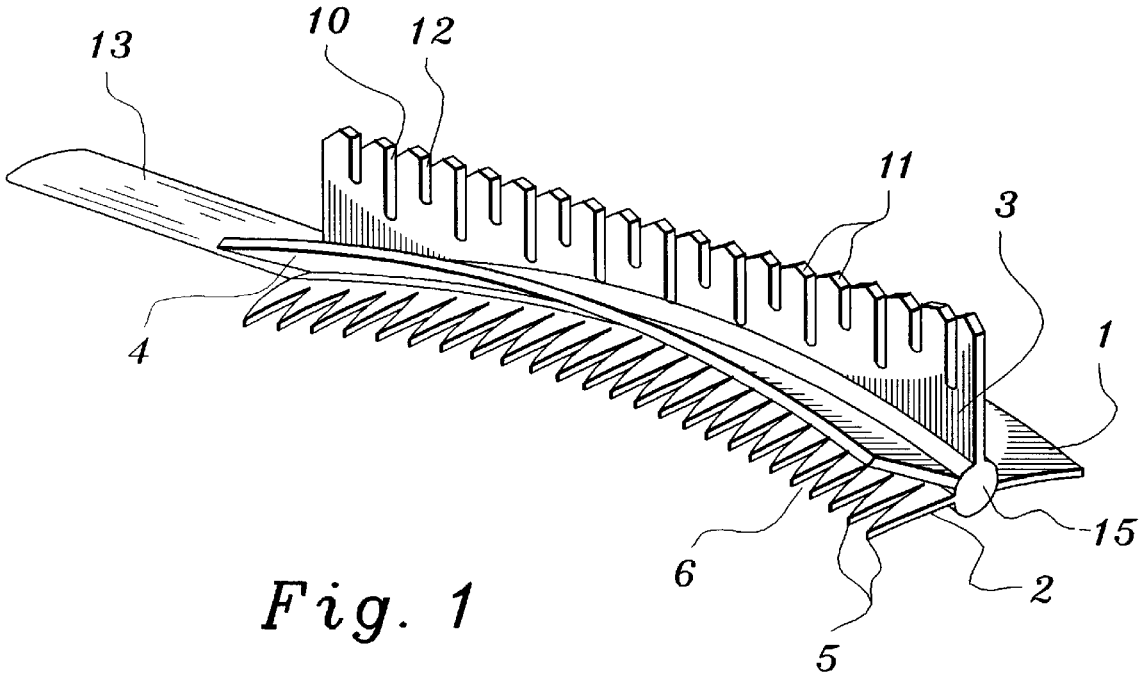
FIG. 1 is an isometric view of the preferred embodiment of the invention, showing the removable shelves attached to the apparatus.

FIG. 1 is an isometric view of the preferred embodiment of the invention. The preferred embodiment has a removable upper shelf 1 and an anchor 2 fixed together longitudinally in approximately a co-planar relationship. A blade 3 is fixed perpendicularly to the shelf 1 and the anchor 2, as shown. The blade 3 comprises first teeth 11 separated by first notches 10 and 12 of alternating depth. The anchor 2 comprises second teeth 5 separated by second notches 6. A removable lower shelf 4 is fixed to the joint between upper shelf 1 and anchor 2 and the blade 3. The lower shelf 4 is disposed in a plane having approximately a 60-degree angle between the blade 3 and the anchor 2 in the preferred embodiment, although the angle is not critical. A handle 13 is fixed to the preferred embodiment along its longitudinal axis. The upper shelf 1, lower shelf 4, anchor 2, and blade 3, form a spine 15, the spine 15 supporting the aforementioned elements in the spatial relationship just described.

The preferred embodiment may be made from any suitable material, such as plastic, wood or metal, or any combination thereof.

Figure 2:
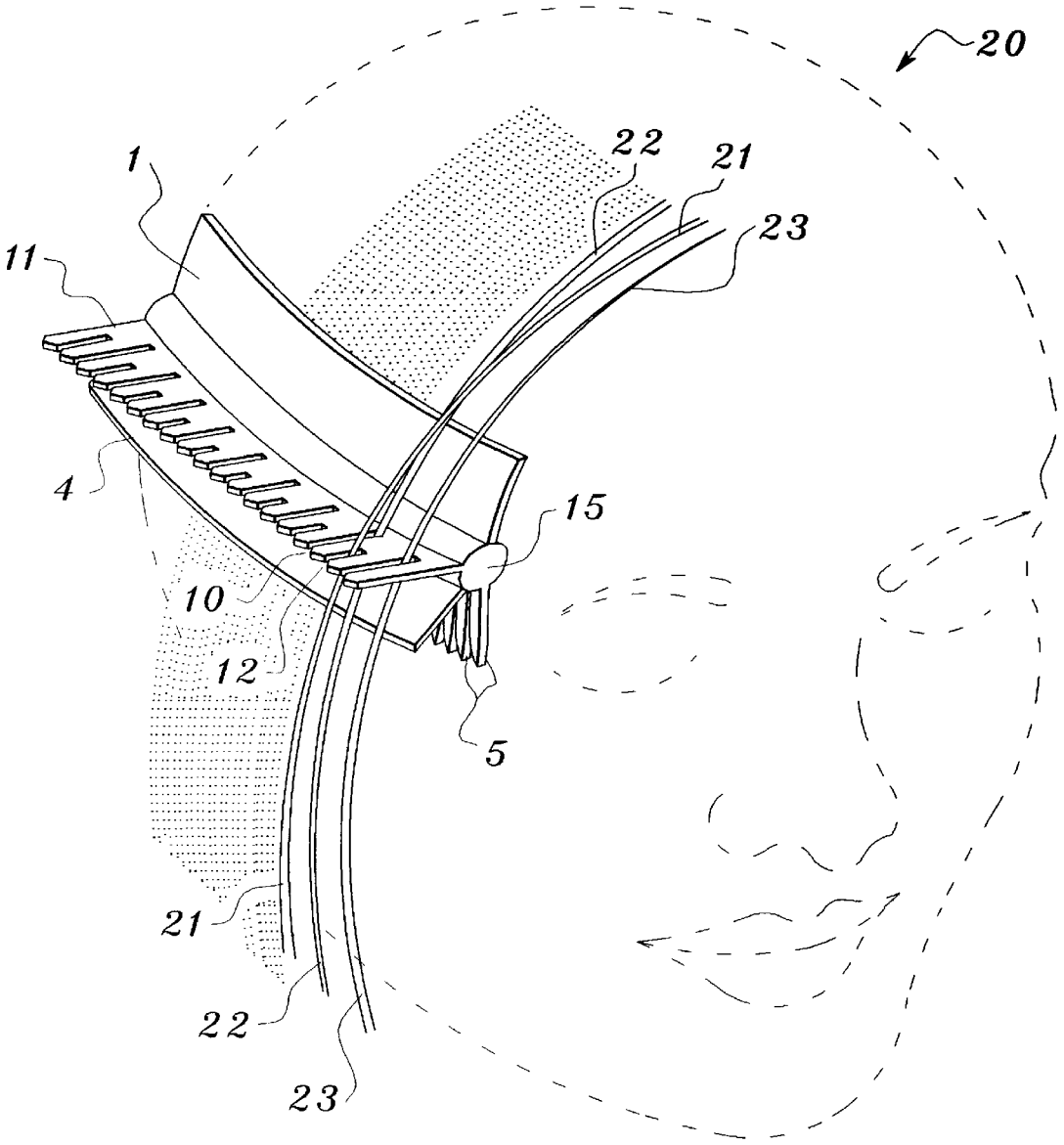
FIG. 2 is an isometric view of the assembled device positioned on a human head.

FIG. 2 shows how the preferred embodiment is used to facilitate braiding of hair on a human head 20. The preferred embodiment is placed against the head 20 so that the upper shelf 1 lies more or less flat against the head 20, and the second teeth 5 of the anchor 2 engage the hair, holding the device firmly against the head 20. Although the anchor 2 appears to be a comb, it functions as an anchor to hold the device against the head. The device is placed against the head 20 so that a layer of hair falls across it. FIG. 2 shows three strands of hair 21, 22, and 23, placed through three first notches 10 and 12, these being two deep first notches 10 and one shallow first notch 12, in the blade 3. Similarly, other strands of hair are selected by the operator and placed in the remaining first notches 10 and 12 of blade 3.

Figure 3:
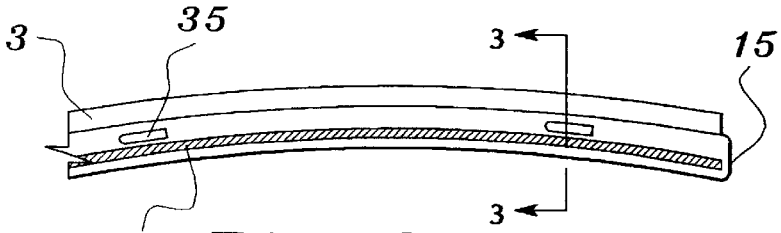
FIG. 3 is a side view of the preferred embodiment, showing the means for fastening and unfastening the shelves from the apparatus.
Figure 7:
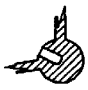
FIG. 7 is a cross-section taken from FIG. 3.

By this means a layer of hair above the upper shelf 1 may be rapidly separated into units of three strands 21, 22, and 23 as shown in FIG. 3. The deep first notches 10 and the shallow first notches 12 separate the strands 21, 22, and 23 from one another into two rows so that they may be easily grasped for braiding.

Figure 4:
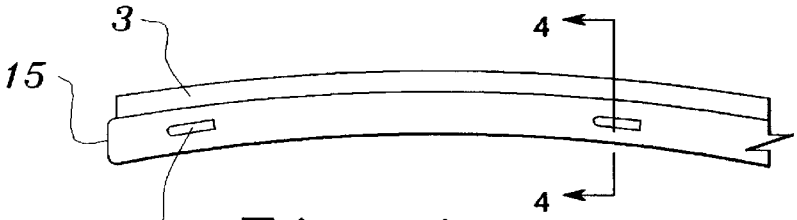
FIG. 4 is a side view of the preferred embodiment, from the side opposite that shown in FIG. 3, showing the means for fastening and unfastening the shelves from the apparatus.
Figure 8:
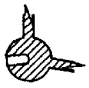
FIG. 8 is a cross-section taken from FIG. 4.
Figure 5:
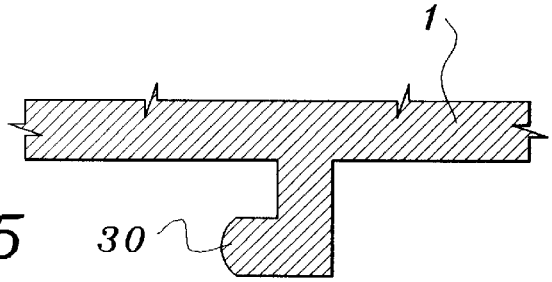
FIG. 5 is a cross-sectional view showing the mechanism for fastening removable shelves to the apparatus in the preferred embodiment.
Figure 6:
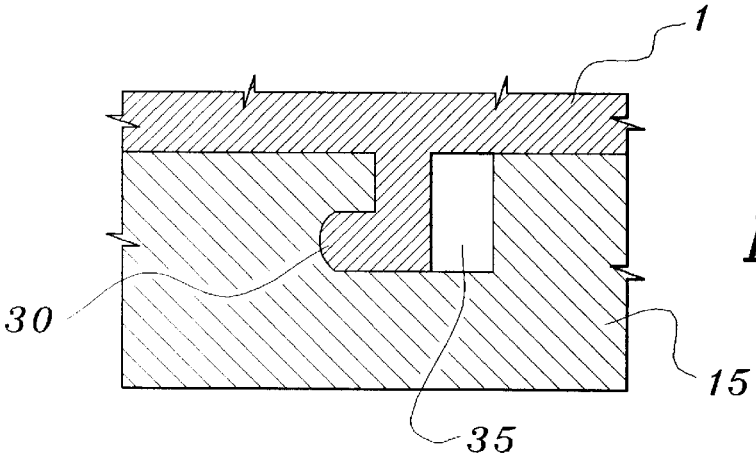
FIG. 6 is a cross-sectional view further showing the mechanism for fastening removable shelves to the apparatus in the preferred embodiment.

The lower shelf 4 holds the strands 21, 22, and 23 away from the remaining hair below the device, and thereby keeps them from tangling with the unbraided hair. However, in some hair styles on some heads, the benefit of the lower shelf 4 may be minimal, and work space may be tight. In this case, the preferred embodiment provides a means for removing and re-attaching the lower shelf 4. As shown in FIGS. 5 and 6, the lower shelf 4 has lugs 30 which engage receptacles 35 in the spine 15. In a similar way, the upper shelf 1, has lugs 31 which engage similar receptacles (not shown) in the spine 15. FIGS. 3 and 4 further illustrate the attachment mechanism of the preferred embodiment. Other methods besides the slot and lug system shown may be used to fasten removable blades to the spine 15, such as clips or grooves receiving the shelves or appendages to the shelves.

When all of the separated units of strands have been braided, the device can be moved lower on the head 20, below another layer of hair, and the process repeated as desired.

The reader will see that the number of braids which can be produced depends on the number of groups of three notches which are disposed along the blade 3. Also, the spacing between the braids may be determined by the width of the first teeth 11 in the blade 3. For example, and by way of illustration only, if the width of the first notches 10 and 12 is constant at 3.18 mm (⅛"), then the following table shows how spacing between the braids is determined by the width of the teeth 11 in blade 3:

| Tooth width | gives braids |
|---|---|
| 6.4 mm (¼") | 28.6 mm (1 ⅛") |
| 9.5 mm (⅜") | 38.1 mm (1 ½") |
| 12.7 mm (½") | 47.6 mm (1 ⅞") |
| 19.1 mm (¾") | 66.7 mm (2 ⅝") |

In the embodiment shown in FIG. 1, the anchor 2 is shown having a slight curve in both its longitudinal and transverse axes. This curve better fits the device to the shape of the subject's head, but its presence is not essential to the function of the invention. If the curve is provided, the removable shelves are provided with sufficient flexibility to allow them to engage the spine 15 as shown.

The reader will see that the need for a way to speed up hair braiding and make it more regular has been met by the present invention, as described above. Since certain changes could be made in the embodiment of the invention described above without departing from the spirit and scope of the invention, I intend that all matter contained in the foregoing description and drawings shall be interpreted as illustrative and not in a limiting sense. The reader should understand that the following claims are intended to cover all of the generic and specific features of the invention herein described and all statements of the scope of the invention which might be interpreted to fall between these features.

I claim:

1. An apparatus for separating hair into strands for braiding comprising:

(a) a spine, (b) a removable upper shelf connected to the spine, (b) an anchor longitudinally connected to the spine and substantially co-planar with the upper shelf, (c) a blade disposed in a plane substantially perpendicular to the upper shelf and the anchor and longitudinally connected to the spine, (d) a removable lower shelf disposed between the blade and the anchor, and connected longitudinally to the spine, (e) a handle connected to the spine,, (f) means integral with the blade for separating hair into strands; and, (g) means integral with the anchor for gripping hair.

2. The apparatus of claim 1 wherein the anchor is curved along its longitudinal and transverse axes so as to more closely fit the shape of a human head.

3. The apparatus of claim 1 wherein the means for separating hair into strands comprises the blade having first teeth; the first teeth being alternately separated by first notches, the first notches having alternating deep and shallow depths, and the blade having a number of first notches equal to a multiple of three.

4. The apparatus of claim 1 wherein the means for gripping hair comprises the anchor having second teeth, the second teeth being equally spaced by second notches.

5. The apparatus of claim 4 wherein the second notches are wider at their distal ends than their proximal ends.

6. The apparatus of claim 1 where the upper shelf and the lower shelf have a plurality of lugs, and the spine has corresponding receptacles for receiving the lugs.

7. An apparatus for separating hair into strands for braiding comprising:

(a) a spine, (b) a removable upper shelf connected to the spine, (b) an anchor longitudinally connected to the spine and substantially co-planar with the upper shelf, the anchor curved along its longitudinal and transverse axes so as to more closely fit the shape of a human head;

(c) a blade disposed in a plane substantially perpendicular to the upper shelf and the anchor and longitudinally connected to the spine, (d) a removable lower shelf disposed between the blade and the anchor, and connected longitudinally to the spine, (e) a handle connected to the spine, (f) the blade having first teeth; the first teeth being alternately separated by first notches, the first notches having alternating deep and shallow depths, and the blade having a number of first notches equal to a multiple of three; and, (g) the anchor having second teeth, the second teeth being equally spaced by second notches.

* * * * *